US005966749A

United States Patent [19]

Goesling et al.

[11] Patent Number: 5,966,749

[45] Date of Patent: Oct. 19, 1999

[54] ADJUSTABLE FLUSH VALVE

[75] Inventors: Kent Goesling, Pomona; Oscar R. Dufau, Fullerton; John McKay, Placentia; Steven E. Maple, Mission Viejo; Adolf Schoepe, Anaheim, all of Calif.

[73] Assignee: Fluidmaster, Inc., San Juan Capistrano, Calif.

[21] Appl. No.: 08/958,170

[22] Filed: Oct. 27, 1997

[51] Int. Cl.[6] ..... E03D 1/34

[52] U.S. Cl. ..... 4/392; 4/395

[58] Field of Search ..... 4/378, 392–395, 4/403, 404

[56] References Cited

U.S. PATENT DOCUMENTS

| | | |
|---|---|---|
| 1,688,877 | 10/1928 | Palmer . |
| 3,040,334 | 6/1962 | Corsaw . |
| 3,935,598 | 2/1976 | Schmidt . |
| 3,955,218 | 5/1976 | Ramsey . |
| 4,145,774 | 3/1979 | Sullivan . |
| 4,189,795 | 2/1980 | Conti . |
| 4,419,773 | 12/1983 | Sullivan . |
| 4,497,076 | 2/1985 | Sullivan . |
| 5,129,110 | 7/1992 | Richter . |
| 5,173,971 | 12/1992 | Schoepe . |
| 5,230,103 | 7/1993 | Antunez . |
| 5,390,375 | 2/1995 | Fernstrum . |

*Primary Examiner*—Charles E. Phillips
*Attorney, Agent, or Firm*—Richard L. Myers

[57] ABSTRACT

A pivotable toilet flush valve member (10) is provided, of the type that includes a float (40) with a pair of holes (44, 52) that allow the float to fill with water during a flushing to close early, and where the float can be turned to vary the amount of water used during a flushing, wherein the float is constructed for easy and loose mounting on a frame (12) and for low friction rotation about a primarily vertical axis (60), and where the flush valve member has a simple detent mechanism to hold the float at any rotational position to which it is turned. The frame has an aperture (74) lying along the primarily vertical axis, and the float has a small diameter upwardly extending projection (70) that projects upwardly through the frame aperture and that is held by the walls of the aperture, for low friction turning. The detent mechanism includes an upstanding wall (100) with an upwardly-open vertical groove (102) that has a plurality of teeth on at least one side of the groove. The frame has a downwardly-extending detent (92) with at least one tooth (111–113) that lies in the groove.

10 Claims, 2 Drawing Sheets

ADJUSTABLE FLUSH VALVE

BACKGROUND OF THE INVENTION

A common type of toilet flush valve member includes a float device with a float and seal, lying at the outer end of a yoke or frame, with the inner end of the frame pivotally mounted about a horizontal axis. When a chain initially pulls the float up to start a flushing, the buoyancy of the float keeps the flush valve member raised until almost all water has exited the tank. Then the flush valve member pivots down and its seal seals against a valve seat while the tank is refilled with water. Most toilets in present use, dispense about three gallons of water in each flushing. Municipalities wish to reduce the amount of waste water that passes through drain pipes and that must be treated before discharge. This can be accomplished by reducing the amount of water dispensed in each flushing.

One approach to reducing water usage, includes providing a second hole in the float, in addition to the drain hole at the bottom of the float. When the flush valve pivots up during a flushing, the second hole allows air to escape from the float chamber while water flows into the float chamber. This progressively decreases the buoyancy of the float, until it becomes heavy enough and closes the flush valve when perhaps only two gallons instead of three have been dispensed.

When setting up the new flush member, it is desirable to be able to adjust, in small increments, the amount of water dispensed in each flushing. This can be accomplished by allowing the float to be turned about a vertical axis, so the vertical height between the air escape hole and the usual water drain hole in a raised flush member can be varied. U.S. Pat. No. 4,419,773 by Sullivan describes an adjustable flush valve member of this type, wherein the frame is provided with a large diameter flange at its periphery, that lies in a horizontal plane (when the valve is lowered). The float device is provided with a groove at its periphery that includes walls lying below and above the flange to enable the float to turn about the flange. Also, the walls of the groove include teeth that are engaged by a detent on the frame to hold the float at any rotational position to which it is turned. While this approach enables fine adjustment of the float rotational position, it can result in difficult mounting of the float device on the frame, rigidizing of the float device seal and possible leakage, and difficult turning of the float device. The enlarged diameter of the rotation joint where the float device is rotatably coupled to the frame, results in high friction against float rotation and the possibility that there can be a "jamming" that makes it difficult to turn the float device. Turning of the float device can be especially difficult because it usually lies at the bottom of a wet tank. A flush valve member whose closing delay is adjustable by turning a float device, wherein float turning occurred with relatively low friction while the float was securely held in any of a plurality of rotational positions, and with the float device being easily mounted on the frame in a"loose" coupling that permitted float device tilt, would be of value.

SUMMARY OF THE INVENTION

In accordance with one embodiment of the present invention, an adjustable-delay toilet flush valve member is provided, which enables predictable turning of the float device to change the delay, while maintaining a tiltable and easily made connection of the float device to a pivotally mounted frame. The frame has a small aperture lying along a primarily vertical axis and the float device has a projection that projects through and above the aperture and that forms a shoulder to hold the float device to the frame in a"floppy" connection that permits tilt of the seal to seal against a valve seat. Separate engaging parts of the frame and float produce a controllable and preferably detentable resistance to rotation. One engaging part is an upstanding wall on the float that is spaced from the projection, with the upstanding wall having an upwardly-opening vertical groove forming teeth. The engaging part of the frame includes a downwardly-extending detent that fits in the groove and that itself has at least one tooth.

The novel features of the invention are set forth with particularity in the appended claims. The invention will be best understood from the following description when read in conjunction with the accompanying drawings.

DESCRIPTION OF THE PREFERRED EMBODIMENT

Figure 1:
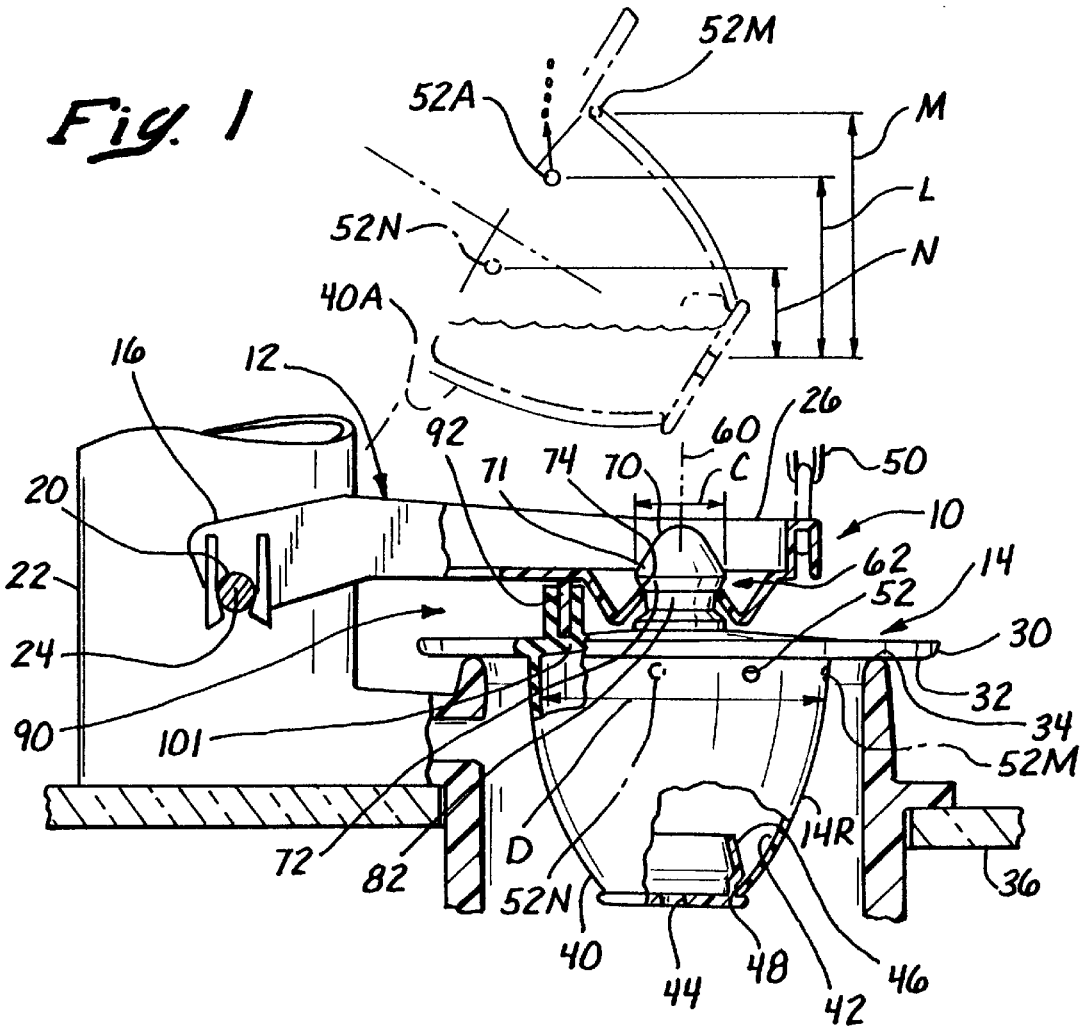
FIG. 1 is a partially sectional side elevation view of a toilet flush valve of the present invention, shown with the frame mounted on an overflow tube and with the float device closed on a valve seat, and showing, in phantom lines, the valve member in its raised position during a flushing.

FIG. 1 illustrates a toilet flush valve 10 of the present invention, which includes a yoke or frame 12 and a float device 14 mounted on the frame. The frame has an inner end 16 mounted on trunnions 20 of a support 22 in the form of an overflow tube, to enable the frame to pivot about a primarily horizontal axis 24. The frame has an outer end 26 that supports the float device 14. The float device 14 includes a seal 30 with a lower seal surface 32 that seals against a valve seat 34 near the bottom of the toilet tank 36. The float device also includes a float or float part 40 that forms a hollow float chamber 42. A water drain hole 44 at the bottom of the float, allows any water lying in the float to drain out when the flush valve member is closed. The entire float device 14, except for a plug 46, is preferably molded in one piece, from elastomeric material. The plug 46 allows the rest 14R of the float device to be easily molded with a large water drain hole 48, while the plug has a smaller drain hole. Also, a tool (or a person's finger) can project up through the large hole 48 to push a protuberance 70 into a frame aperture 74.

When a chain 50 is pulled high enough, the float 40 floats up in water in the tank, as to the position 40A. Previously, the large buoyancy of the float resulted in it beginning to move down and close only when almost all water in the tank had been flushed out. However, the float 40 is of a type that includes an air escape hole 52. When the float has pivoted up to 40A, the air hole at 52A lies a considerable distance L above the water drain hole at 44A. As a result, air in the float can pass out through the hole 52A while water flows into the float through the hole 44A, which progressively decreases the amount of air in the float and therefore decreases its buoyancy. When the buoyancy has decreased sufficiently, the float begins to sink and move down against the valve seat 34, even though the water level has not decreased to the level of the raised float.

The float device 14 is mounted to turn about a primarily vertical axis 60 on the frame (the axis 60 is vertical only when the valve is closed). This enables the air escape hole 52 to be moved between one extreme position 52M which results in the greatest difference M between the heights of the holes, and another extreme position 52N for the least difference N in heights of the holes. At the hole position 52M, the float rapidly fills with water and quickly closes so considerable water is saved, while in the other extreme position 52N there is little change from a float without an air hole.

Although the float device 14 includes a main part 14R that is an integrally molded item of medium soft elastomeric material, there is a danger that the seal surface 32 will not form a tight seal against the valve seat 34. Applicant supports the float device 14 on the frame outer end 26 in a"loose" joint 62 that permits tilting of the float device so the primarily vertical axis 60 of the float device can tilt about 10° (at least 1°) from the vertical in any direction. This type of joint is described in U.S. Pat. No. 5,173,971 by Schoepe et al. In this type of joint, the float device is provided with an upwardly-extending projection or protuberance 70 that has an enlarged head 71 and a partially downwardly-facing shoulder 72. The frame outer end has an aperture 74 with aperture walls that engage the shoulder 72 to prevent downward movement of the projection 70 after it has been installed. Actually, as shown in applicant's FIG. 3, the frame walls 76 are divided into a plurality of tabs 80 that permit installation of the projection by deflection of the tabs. The flexibility of the tabs and the fact that there is a groove 82 below the shoulder 52, all enable the float device to tilt so its seal surface lies in the same plane as the valve seat 34 to effectively seal against the valve seat.

Figure 2:
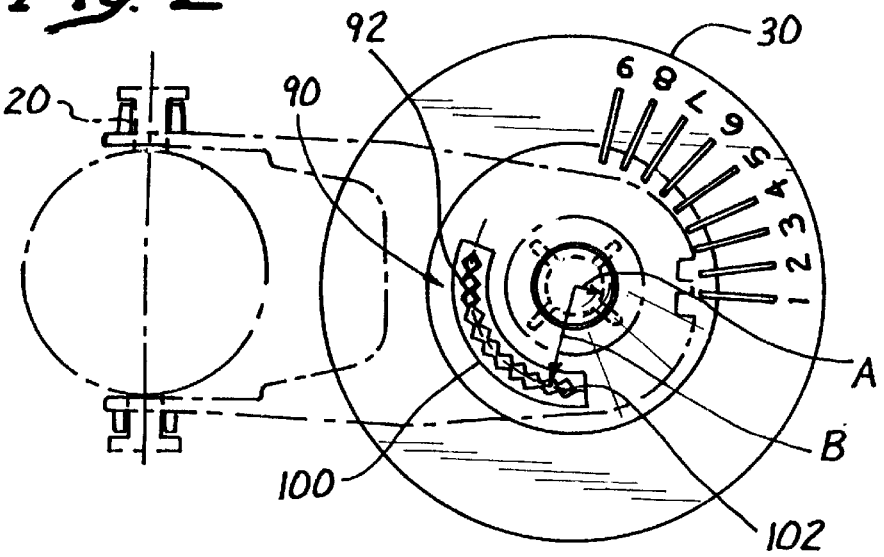
FIG. 2 is a plan view of the float device of FIG. 1, and also showing, in phantom lines, the frame of the valve member.
Figure 3:
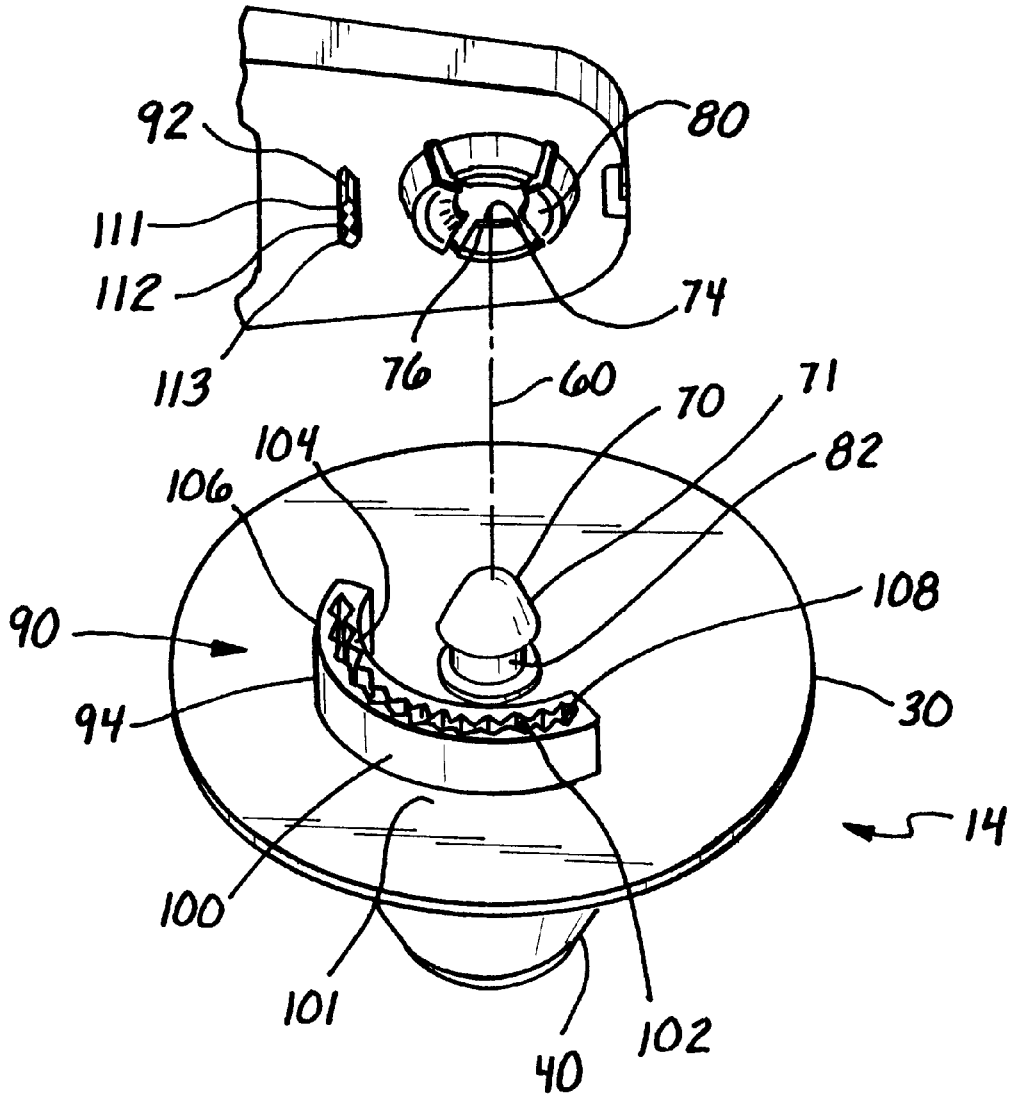
FIG. 3 is an exploded partial isometric view, including a top isometric view of the float device and a partial bottom isometric view of the frame, of the flush valve member of FIG. 1.

The projection 70 has a relatively small diameter C (FIG. 1) at its outside and an even smaller diameter at its shoulder 72. This permits turning of the float device 14 with relatively small torque to overcome friction. A ratchet mechanism 90 is provided to hold the float in any rotational position between its extremes. The ratchet mechanism 90 has a construction such as shown in FIG. 3, wherein the frame and float device have engaging parts 92, 94 that are radially spaced from the projection 70. The projecting part 94 of the float includes an upstanding wall 100 that extends upwardly from the top wall 101 of the float 40. The upstanding wall 100 has an upwardly-facing groove 102 with opposite groove walls 104, 106. At least one and preferably both of the groove walls 104, 106 form teeth 108. The engaging part 92 of the frame forms at least one tooth, with three of such teeth 111–113 being shown at each radially opposite side of the part. When the projection 70 is inserted through the aperture 74, the engaging part or detent 92 of the frame moves down into the groove 102. This makes it very easy to assemble the float device on to the frame. Thereafter, the float device can be turned within an angle of 120°. FIG. 2 shows that the float has lines 110, spaced 10° apart, which is the same as the tooth spacing. The lines and associated numbers "1–9" indicate changes in the amount of water used in each flushing.

In a flush valve member that applicant has constructed, the float had an overall diameter D (FIG. 1) of 43 mm, the projection 70 had a diameter C of 10 mm, and the groove 102 had a radius B (FIG. 2) from the axis 60, of 15 mm (if it were a circle it would have a diameter of 30 mm). It is noted that the upstanding wall 100 lies radially inward from the seal 30 (the portion that projects radially beyond the top of the float) or at least the seal diameter that engages the valve seat 34, to avoid interference with flexibility of the seal 30.

Thus, the invention provides a toilet flush valve with a variable delay, of a type where the float and preferably the float device can turn about a primarily vertical axis (when the flush valve member lies in its closed position), which maintains a"floppy" and easily made mounting of the float device on the frame, keeps the seal of the float device flexible and provides low friction turning with a separate detent mechanism. This is accomplished by mounting the rotatable float device on the frame by the use of a small diameter projection with an enlarged head, that projects up and through a hole in the frame, and by providing a separate detent mechanism spaced radially outward from the projection, but with the ratcheting mechanism preferably lying radially inward of the seal. The detent mechanism includes an upwardly-facing groove that receives a detent depending from the frame.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A toilet flush valve member of the type that has a frame with an inner end that can pivot about a primarily horizontal axis on a support and that has an outer end, wherein said valve member has a float device mounted on the frame with the float device including a seal that can move upwardly off a valve seat to open it and down against the valve seat to close it as the frame pivots, where the float device includes a hollow float and said float device can turn about a primarily vertical axis with respect to said frame, with said float having openings that are vertically spaced when the valve member pivots up during a flushing, wherein:

said float device and said frame having engaging parts that resist turning of said float device about said primarily vertical axis, with a controlled resistance;

first portions of the float device included in the engaging parts and forming a vertical groove defined by a plurality of teeth;

second portions of said frame included in the engaging parts and forming at least one tooth cooperating with the vertical groove to form a detent providing a controlled resistance to turning of the float device about said primarily vertical axis;

said frame has an aperture lying along said primarily vertical axis and said float device has a protuberance with an enlarged head that projects upwardly through and above said aperture, with said frame having aperture walls that hold said protuberance to said frame, with said protuberance being rotatable about said primarily vertical axis within said aperture, and with said engaging parts being spaced radially outward of said aperture, to obtain low friction in rotation of said protuberance in said aperture and to provide controlled resistance at a larger radius from said primarily vertical axis.

2. The flush valve described in claim 1 wherein:

said protuberance which lies above said aperture, has an outside diameter that is less than half the diameter of said float and of said seal, whereby to obtain low friction pivoting.

3. The flush valve described in claim 1 wherein:

said float device includes an integral molded part that includes said seal and said float, and said float device includes a separate plug;

said opening includes upper and lower openings, and with said lower opening including a large diameter hole at the bottom of said molded part and with said plug fitting into said large diameter hole and with said plug having a smaller diameter hole that forms said lower opening.

4. A toilet flush valve member of the type that has a frame with an inner end that can pivot about a primarily horizontal axis on a support and that has an outer end, wherein said valve member has a float device mounted on the frame with the float device including a seal that can move upwardly off a valve seat to open it and down against the valve seat to close it as the frame pivots, where the float device includes a hollow float and said float device can turn about a primarily vertical axis with respect to said frame, with said float having openings that are vertically spaced when the valve member pivots up during a flushing, wherein:

said float device and said frame having engaging parts that resist turning of said float device about said primarily vertical access, with a controlled resistance;

said engaging part of said float device comprises an upstanding wall with an upwardly open vertical groove therein that has a groove wall that forms a plurality of teeth;

said engaging part of said frame comprises a downwardly-extending detent that fits in said groove and that has at least one tooth, with said detent moveable down into said groove as said protuberance head moves up through said aperture; and said frame has an aperture lying along said primarily vertical axis and said float device has a protuberance with an enlarged head that projects upwardly through and above said aperture, with said frame having aperture walls that hold said protuberance to said frame, with said protuberance being rotatable about said primarily vertical axis within said aperture, and with said engaging parts being spaced radially outward of said aperture, to obtain low friction in rotation of said protuberance in said aperture and to provide controlled resistance at a larger radius from said primarily vertical axis.

5. A toilet flush valve, comprising:

a float device that has a primarily vertical axis, said float device forming a downwardly facing seal surface, a hollow float extending primarily below said seal surface and having at least two holes, and a projection that extends upwardly above said float along said axis, with said projection forming a shoulder that faces at least partially downward and extending around said axis;

a frame that has an inner end forming a primarily horizontal pivot axis, and an outer end forming an aperture that receives said projection, said frame having walls that abut said shoulder to support said float device while allowing it to turn about said primarily vertical axis;

said float device and said frame having engaging parts that are radially outwardly spaced from said projection and said aperture but inwardly from said seal, with said engaging parts forming a detent mechanism;

said engaging parts include an elastomeric wall extending upwardly from said float with said elastomeric wall forming a groove that is curved about said axis, said groove having opposite groove side walls that face each other and at least one of said groove side walls forming a plurality of teeth; and said frame has a detent with a tooth that lies in said groove and that engages said one of said groove side walls.

6. A toilet flush valve, comprising:

a float device that has a primarily vertical axis, said float device forming a downwardly facing seal surface and forming a float extending primarily below said seal surface and having at least two holes;

a frame that has an inner end forming a primarily horizontal pivot axis and an outer end, said float device being rotatably mounted about said primarily vertical axis on said frame outer end;

said float device forming an upwardly-opening groove that is curved about said primarily vertical axis and that has radially inner and outer groove side walls with at least one of said side walls forming a plurality of teeth, and said frame includes a detent with at least one tooth that lies in said groove and engages said side wall that forms a plurality of teeth.

7. The flush valve recited in claim 6, wherein the detent is disposed radially outwardly of the primarily vertical axis and radially inwardly of the seal surface.

8. The flush valve described in claim 6 wherein:

said float device has an upward protrusion with an enlarged head lying on said primarily vertical axis, and said frame out end has an aperture through which said protrusion extends, whereby to facilitate installation of said float device on said frame.

9. The toilet flush valve recited in claim 6, wherein a plurality of teeth include at least three teeth.

10. The toilet flush valve recited in claim 6, further comprising:

indicia disposed on the float device and providing an indication of water flush volume through the toilet flush valve.

* * * * *